US006022631A

United States Patent [19]

Ohmura et al.

[11] Patent Number: 6,022,631

[45] Date of Patent: Feb. 8, 2000

[54] NICKELLED STEEL SHEET PROOFED AGAINST TIGHT ADHESION DURING ANNEALING AND PROCESS FOR PRODUCTION THEREOF

[75] Inventors: Hitoshi Ohmura; Hideo Ohmura; Tatsuo Tomomori, all of Yamaguchi-ken, Japan

[73] Assignee: Toyo Kohan Co. Ltd., Tokyo, Japan

[21] Appl. No.: 08/973,002

[22] PCT Filed: May 23, 1996

[86] PCT No.: PCT/JP96/01368

§ 371 Date: Dec. 1, 1997

§ 102(e) Date: Dec. 1, 1997

[87] PCT Pub. No.: WO96/38600

PCT Pub. Date: Dec. 5, 1996

[30] Foreign Application Priority Data

Jun. 1, 1995 [JP] Japan ..... 7-159851

[51] Int. Cl.[7] ..... C23C 28/00; C25D 5/26

[52] U.S. Cl. ..... 428/632; 428/679; 148/241; 148/279; 148/518; 228/118

[58] Field of Search ..... 428/632, 679, 428/680, 681, 586; 148/241, 279, 518; 228/118

[56] References Cited

U.S. PATENT DOCUMENTS

| | | |
|---|---|---|
| 4,363,677 | 12/1982 | Ichiyama et al. . |
| 4,582,546 | 4/1986 | Bird et al. . |
| 4,746,453 | 5/1988 | Chen et al. . |
| 4,902,387 | 2/1990 | Takeuchi et al. . |
| 5,112,698 | 5/1992 | Horvei et al. . |
| 5,127,971 | 7/1992 | Komatsubara et al. . |
| 5,587,248 | 12/1996 | Ohmura et al. . |
| 5,618,401 | 4/1997 | Nomura et al. . |

FOREIGN PATENT DOCUMENTS

| | | |
|---|---|---|
| 52-150749 | 12/1977 | Japan . |
| 55-082726 | 6/1980 | Japan . |
| 55-91993 | 7/1980 | Japan . |
| 58-11796 | 1/1983 | Japan . |
| 4-154973 | 5/1992 | Japan . |
| 5-202455 | 8/1993 | Japan . |
| 6-344003 | 12/1994 | Japan . |
| 6-346284 | 12/1994 | Japan . |

*Primary Examiner*—Deborah Jones
*Assistant Examiner*—Jason Savage
*Attorney, Agent, or Firm*—Browdy and Neimark

[57] ABSTRACT

Adhesion of nickel plated steel sheets with each other, which is apt to occur during producing a steel sheet in which nickel is diffused by heat treatment of a nickel plated steel sheet in an annealing furnace, is prevented. A nickel plated steel sheet having a nickel-iron diffusion layer of 0.5–10 $\mu$m thickness, a nickel plated layer thereon of 0.5–10 $\mu$m thickness, and a silicon oxide layer thereon as an amount of silicon of 0.1–2.5 mg/m$^2$ are formed on at least one face of a cold rolled steel plate. After the nickel is plated on the cold rolled steel plate, silicon hydrate is precipitated by dipping or electrolysis treatment in a bath of sodium orthosilicate as a main component, followed by heat treatment.

8 Claims, 2 Drawing Sheets

NICKELLED STEEL SHEET PROOFED AGAINST TIGHT ADHESION DURING ANNEALING AND PROCESS FOR PRODUCTION THEREOF

BACKGROUND AND OBJECTIVES

The present invention relates to a nickel plated steel sheet and the manufacturing method thereof wherein it is planned to prevent adhesion of steel sheet with each other, which is apt to occur during producing a steel sheet (shown as diffused nickel diffused plated steel sheet, herein after) in which nickel is diffused by heat treatment of a nickel plated steel sheet in an annealing furnace.

Generally, a nickel diffused plated steel sheet is rewound as a tight coil after plating, and then is heat treated in a box-annealing furnace around 500–700° C. in order to give workability. However, this heat treatment causes a problem that since diffusion of nickel on the steel sheet surface proceeds, rewound and stacked steel sheets adhere with each other. Therefore, conventionally, heat treatment preventing direct contact of steel sheets with each other has been carried out in such a way that steel sheet is annealed in the openly coiled state where steel sheet is coiled with a wire or the like as a spacer which makes gap between rewound steel sheets, or it is annealed in the state where it is previously coated with a releasing agent such as an oxide, a carbide, or a nitride which are stable in high temperature.

However, the method of annealing in the state that steel sheet is rewound with a wire stacking to it is not efficient since it is apt to be scratched and requires extra work for rewinding and removing of the wire. Moreover, the annealing method with coating of releasing agent on a steel sheet surface has some problems such as the increment of cost by using a releasing agent, difficulty of removing of the releasing agent, and visual affection of the steel sheet surface, and therefore either method lacks industrial practicability.

The prevention of adhesion of a cold rolled steel plate during annealing, that is not for nickel plated steel sheet, is practiced by coating a releasing agent such as oxide of titanium or aluminum on the steel sheet surface (laid-open Japanese patent Sho 63-235427 and so on).

However, since these oxides are remained on the steel sheet surface after annealing, it has a disadvantage of deteriorated appearance of steel surface caused by affected color tone. For these reasons, the above-mentioned wire has been used in the heat treatment of a nickel plated steel sheet but oxide has not been used.

It is a technical objective of the present invention to provide a nickel plated steel sheet treated for the prevention of adhesion in order to suppress adhesion of the plated steel sheets with each other during the heat treatment of the steel sheet plated with nickel.

The nickel plated steel sheet of the present invention does not need rewinding of a wire or coating of a releasing agent for the prevention of adhesion and can have superior appearance after the heat treatment.

SUMMARY OF THE INVENTION

The nickel plated steel sheet of the present invention is characterized that it has a nickel-iron diffusion layer having a thickness of 0.5–10 $\mu$m, a nickel plated layer thereon having a thickness of 0.5–10 $\mu$m, and a silicon oxide layer thereon as an amount of silicon of 0.1–2.5 mg/m$^2$ which are formed on at least one face of a cold rolled steel plate.

The nickel plated steel sheet of the present invention may be also characterized that it has a nickel-iron diffusion layer having a thickness of 0.5–10 $\mu$m and a silicon oxide layer thereon as an amount of silicon of 0.1–2.5 mg/m$^2$ which are formed on at least one face of a cold rolled steel plate.

Also, the manufacturing method of a nickel plated steel sheet of the present invention is characterized that nickel is plated on a cold rolled steel plate and then silicon hydrate is precipitated by dipping or electrolysis treatment in a bath of sodium orthosilicate as a main component, followed by heat treatment.

Moreover, the nickel plated steel sheet can be also produced by a method that nickel is plated on a cold rolled steel plate and then silicon hydrate is precipitated in a bath of sodium orthosilicate as a main component at current density of 0.1–20 A/dm$^2$ and total quantity of electricity of 0.1–1000 Coulomb/dm$^2$ followed by heat treatment.

It is preferable to alternatively practice A treatment and C treatment in a process of producing silicon hydrate layer on these nickel plated layer.

A nickel plated steel sheet having superior appearance after heat treatment and superior adhesion prevention of steel sheets with each other during heat treatment can be obtained by dipping treatment or electrolysis treatment under a specific condition in a bath of sodium orthosilicate, after nickel is plated on a cold rolled steel plate.

DETAILED DESCRIPTION OF THE INVENTION

Figure 1A:
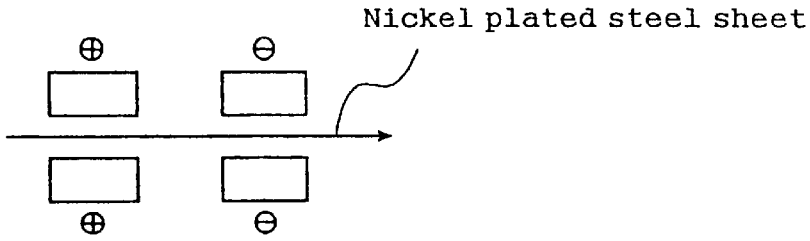
FIG. 1 is a schematic diagram of a manufacturing process of forming silicon hydrate on a nickel plated steel sheet.
Figure 1B:
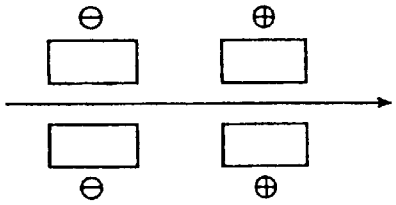
Figure 1C:
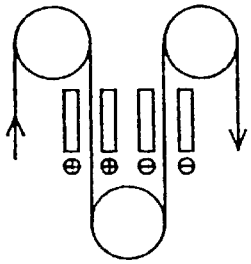
Figure 1D:
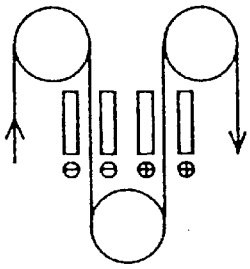

The present invention will be described in further detail by example.

The nickel plated steel sheet of the present invention has a nickel-iron diffusion layer having a thickness of 0.5–10 $\mu$m, a nickel plated layer thereon having a thickness of 0.5–10 $\mu$m, and a silicon oxide layer thereon as an amount of silicon of 0.1–2.5 mg/m$^2$ which are formed on at least one face of a cold rolled steel plate.

The above-mentioned nickel plated layer is preferably produced from a viewpoint of corrosion resistance. However, it is not necessarily produced. In this case, it is preferable that the nickel plated steel sheet has a nickel-iron diffusion layer which has a thickness of 0.5–10 $\mu$m and a silicon oxide layer thereon as an amount of silicon of 0.1–2.5 mg/m$^2$ which are formed on at least one face of a cold rolled steel plate.

Silicon oxide layer has as an amount of silicon of 0.1–2.5 mg/m$^2$, because, in the case of less than 0.1 mg/m$^2$ as lower limit, it does not sufficiently prevent the adhesion during the heat treatment. On the other hand, the amount exceeding 2.5 mg/m$^2$ is not preferable, because the appearance of the plated steel sheet is discolored to white by silicon oxide, and the inherent color tone of the nickel plating is affected.

Moreover, since silicon hydrate is precipitated from sodium orthosilicate bath in the present invention, it is extremely fine and peculiar color tone of nickel plating can be maintained as it is.

Silicon hydrate which is precipitated from sodium orthosilicate bath is dehydrated to a silicon oxide by a subsequent process of heat treatment.

In the present invention, an amount of precipitated silicon oxide is defined as a silicon amount due to an analysis convenience of silicon oxide, that is, the amount of silicon in silicon oxide is determined by means of X-ray fluorescence analysis.

Silicon hydrate is produced from dipping a cold rolled steel plate after nickel plating in a bath of sodium orthosilicate as a main component or electrolysis treatment of it in a bath of sodium orthosilicate as a main component followed by heat treatment. However, electrolysis method has superior coating efficiency to that of dipping method.

FIG. 1 is a schematic diagram of a manufacturing process to precipitate silicon hydrate by an electrolytical treatment on a surface of nickel plated steel sheet in a bath of sodium orthosilicate as a main component.

Any treatment tank such as horizontal type treatment tank as shown in FIG. 1 (*a*) or (*b*) or vertical type treatment tank as shown in FIG. 1 (*c*) or (*d*) can be used for the electrolysis treatment above-mentioned.

The producing method of a precipitation layer of silicon hydrate on a surface of nickel plated steel sheet includes one in which a C treatment, i.e. an cathodic treatment, is practiced first (steel sheet side is cathode) followed by an A treatment, i.e. an anodic treatment, at the next process stage (steel sheet side is anode) as shown in FIG. 1 (*a*) or (*c*).

The method in which A treatment is practiced first followed by C treatment can be also used as shown in FIG. 1 (*b*) or (*d*).

Since the surface of the plated steel sheet can be cleaned in these treatments, any of the above-mentioned treatment is effective to precipitate a large amount of silicon hydrate on the surface of nickel plated steel sheet.

Especially, the process in which C treatment is practiced first followed by A treatment is superior for the point of the precipitation efficiency of silicon hydrate on the surface of nickel plated steel sheet.

Moreover, C treatment→ A treatment or A treatment→ C treatment may be repeated several times by arranging a large number of treatment tank and electrode.

Furthermore, the polarity can be the same at the beginning and the ending such as C treatment-A treatment-C treatment or A treatment-C treatment-A treatment for the plural number of repeating treatment above-mentioned.

Generally, an aluminum killed steel sheet of low carbon content is suitably used as a cold rolled steel plate. Also, a cold rolled steel plate produced from non-aging low carbon steel further added by niobium, boron, and titanium can be used. Generally, a steel sheet that is electrolytically cleaned, annealed, and temper rolled after cold rolling is used as a substrate for plating, and a steel sheet just after cold rolling can be also used as a substrate for plating. In this case, recrystallization annealing of the steel substrate and thermal diffusion treatment of nickel plated layer can be carried out at the same time after nickel is plated after cold rolling.

Nickel plated layer is produced which has a thickness of 0.5–10 $\mu$m formed on at least one face of a cold rolled steel plate. The thickness of nickel plated layer less than 0.5 mm cannot produce sufficient corrosion resistance in case of being used in the as usual atmosphere. On the other hand, the thickness exceeding 10 mm saturates the improvement effect of corrosion resistance, which is not economical. Any known plating bath such as watts bath, sulfamate bath, and chloride bath can be used as a nickel plating bath in the present invention. Although mat plating, semi-gloss plating, and gloss plating are also known as for type of plating, mat plating or semi-gloss plating except for gloss plating added by organic compound containing sulfur is preferably applied in the present invention. Gloss plating is not preferable for the present invention, because plated film produced from gloss plating in which sulfur remains becomes brittle during heat treatment mentioned below and also deteriorates corrosion resistance.

The thus nickel plated steel sheet is treated by dipping or electrolysis treatment in a solution of sodium orthosilicate. A concentration of sodium orthosilicate is preferably 1–7%, more preferably 2–4%.

In the case of the concentration less than 1%, a small amount of silicon hydrate is precipitated on the steel sheet and the necessary amount not less than 0.1 mg/m$^2$ of silicon oxide cannot be obtained by the subsequent heat treatment which is apt to cause adhesion of the plated steel sheets with each other during the heat treatment. Also, in the case of carrying out electrolysis treatment, it causes a problem of the increase of treatment voltage.

On the other hand, a concentration not less than 7% is not economical, because the amount of the solution of sodium orthosilicate taken out from the treatment bath increases with traveling of the steel sheet. Also, it endangers handling of the treatment bath, which is not preferable.

Preferably, total quantity of electricity to carry out electrolysis treatment for coating silicon hydrate is 0.1–1000 Coulomb/dm$^2$.

In the case of total quantity of electricity less than 0.1 Coulomb/dm$^2$, it produces a poor coating efficiency of silicon hydrate on the plated steel sheet is small, and the necessary amount not less than 0.1 g/m$^2$ of silicon oxide cannot be obtained which is apt to cause adhesion of the steel sheets with each other during the heat treatment.

On the other hand, even if total quantity of electricity increases not less than 1000 Coulomb/dm$^2$, a surplus amount of silicon oxide cannot be precipitated on the steel sheet, which is not economical.

Several kinds of thickness of nickel-iron diffusion layer ranging between 0.5–10 $\mu$m can be produced by heating nickel plated steel sheet, which is treated with a solution of sodium orthosilicate above-mentioned and is rewound as a coil, at not more than temperature around 500–700° C. for not less than several hours using box-annealing method. The thickness of the diffusion layer can be controlled by changing the heat treatment temperature and the duration.

Superior adhesion of the steel substrate and the nickel plated layer and of the steel substrate and the nickel-iron diffusion layer can be obtained by forming a nickel-iron diffusion layer. The thickness of nickel-iron diffusion layer less than 0.5 $\mu$m cannot produce sufficient adhesion of the steel substrate and it and the plating is apt to peel off in case of being formed by a severe working such as deep drawing. On the other hand, the thickness of nickel-iron diffusion layer exceeding 10 $\mu$m saturates the improvement effect of adhesion and is not economical.

EMBODIMENT

Example

A cold rolled steel plate of 0.3 mm in thickness was cut out a size of 100 mm by 100 mm and was electrolytically degreased and was pickled in sulfuric acid, and then nickel plated on one face of it on the condition mentioned below. Thus, the nickel plated steel sheets having varied nickel plating thickness were produced. Thereafter, dipping or electrolysis treatment was carried out on them in the solution of sodium orthosilicate on various conditions.

Nickel Plating

| | | |
|---|---|---|
| Bath composition: | Nickel sulfate | 300 g/l |
| | Nickel chloride | 40 g/l |
| | Boric acid | 30 g/l |
| | Lauryl sodium sulfate | 0.5 g/l |
| | Semi-gloss agent | 1 g/l |
| pH: | 4.1–4.6 | |
| Bath temperature: | 55 ± 2° C. | |
| Current density: | 10 A/dm2 | |

The nickel plated steel sheets having varied thickness were produced by changing the plating duration on the condition above-mentioned.

Electrolytical Precipitation Treatment of Silicon Hydrate in the Solution of Sodium Orthosilicate Treatment bath: Sodium orthosilicate 30 g/l Bath temperature: 50±5° C.

Controlling of coating amount: Either of the following

Dipping Treatment

The treated steel sheets having varied coating amount of silicon oxide were produced by changing the dipping duration variously.

Electrolysis Treatment

Current density: 5 A/dm$^2$

Figure 2:
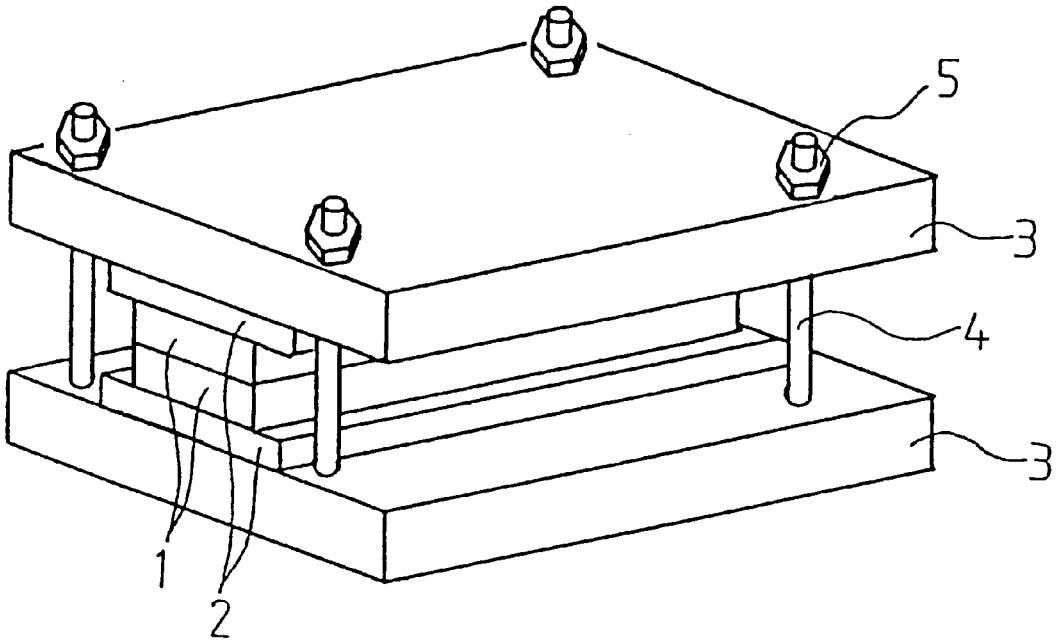
FIG. 2 is a perspective diagram showing a fixing and tightening of nickel plated steel sheets at a constant pressure.
Figure 3:
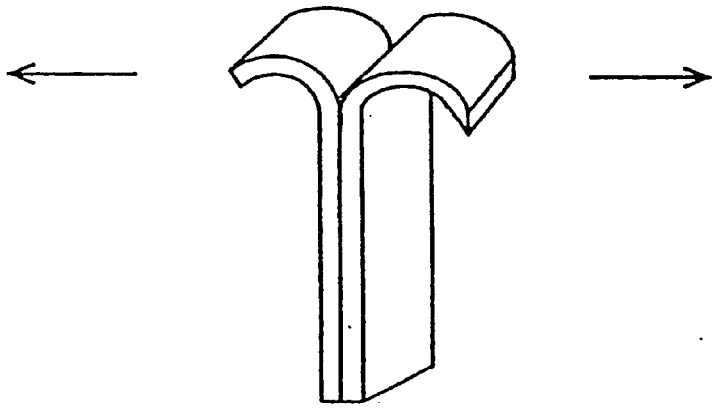
FIG. 3 is a perspective diagram showing a compulsory peeling of two sheets of adherent test piece.

The treated steel sheets having varied coating amount of silicon hydrate were produced by changing the quantity of electricity and polarity variously.

on the same condition as shown in FIG. 2, and it was fastened and fixed through hard plate 2 and fixing and tightening plate 3 which were placed to contact with it up and down by four sets of bolt 4 and nut 5 using torque wrench so as to act the same fixing and tightening force of 3 kgf/mm$^2$ regularly on each test piece. The test piece thus fixed and tightened was heat treated in a protective gas atmosphere consisting of hydrogen of 6.5% and nitrogen as a bulk by varying the temperature (550–700° C.) and the duration (1–10 hours). After the heat treatment, one end portion of the adhered faces of two sheets of the adherent test piece was compulsory peeled off as shown in FIG. 3 and both peeled end portions were bent as a T letter shape for the tensile test piece so as to be set at both chucking portions of a tensile test equipment. This tensile test piece was peeled off by the tensile test equipment and the adhesion strength that is the strength by which peeling starts was measured, and the adhesion degree of the test piece by the heat treatment (the adhesion prevention ability) was evaluated based on the standard mentioned below.

Good: peeled off by tension less than 3 kg

Poor: peeled off by tension not less than 3 kg

The treatment condition of samples and the results of evaluation are shown in Table 1.

Table 1

The nickel plated steel sheet of the present invention hardly adheres with each other during heat treatment as shown in Table 1.

However, in the comparative example, the nickel plated steel sheet without formation of silicon oxide layer on it caused the adhesion of steel sheets with each other during the heat treatment.

TABLE 1

| | | Precipitation condition of silicate in a solution of sodium orthosilicate | | | | | | Adhesion prevention performance of steel sheets with each other during heat treatment |
|---|---|---|---|---|---|---|---|---|
| | Sample No | Method of Precipitation | Order of electrolysis | Total quantity of electricity (Coulomb/dm$^2$) | Si amount (mg/m$^2$) | Condition of heat treatment Temperature ° C. | Duration hs | |
| Present invention | 1 | dipping | — | — | 0.38 | 550 | 10 | good |
| | 2 | electrolysis | A treatment→ C treatment | 100 | 1.07 | 650 | 8 | good |
| | 3 | electrolysis | C treatment→ A treatment | 100 | 1.17 | 650 | 8 | good |
| | 4 | electrolysis | C treatment | 15 | 0.51 | 600 | 8 | good |
| | 5 | electrolysis | A treatment | 250 | 1.70 | 650 | 8 | good |
| | 6 | electrolysis | C treatment→ A treatment→ C treatment | 250 | 1.84 | 700 | 1 | good |
| | 7 | electrolysis | C treatment→ A treatment→ C treatment→ A treatment | 1000 | 2.48 | 700 | 1 | good |
| | 8 | electrolysis | A treatment→ C treatment→ A treatment→ C treatment | 1000 | 2.30 | 700 | 1 | good |
| Comparative examples | 9 | — | — | — | 0 | 550 | 10 | poor |
| | 10 | — | — | — | 0 | 650 | 8 | poor |
| | 11 | — | — | — | 0 | 700 | 1 | poor |

Samples having a size of 100 mm by 30 mm were cut from the treated steel sheet obtained as mentioned above and they were stacked as a stacking block 1 so as to contact the treated surface of two sheets of sample which were treated The nickel plated steel sheet of the present invention has superior ability of adhesion prevention during heat treatment. Namely, the plated steel sheet does not adhere with each other during the heat treatment for the diffusion of nickel into the steel sheet even in the state that the nickel plated steel sheet is rewound as a coil.

We claim:

1. A nickel plated steel sheet having a nickel-iron diffusion layer which has a thickness of 0.5–10 μm, a nickel plated layer thereon which has a thickness of 0.5–10 μm, and a silicon oxide layer thereon as an amount of silicon of 0.1–2.5 $mg/m^2$ which are formed on at least one face of a cold rolled steel plate.

2. A nickel plated steel sheet having a nickel-iron diffusion layer which has a thickness of 0.5–10 μm and a silicon oxide layer thereon as an amount of silicon of 0.1–2.5 $mg/m^2$ which are formed on at least one face of a cold rolled steel plate.

3. A manufacturing method of a nickel plated steel sheet treated for prevention of adhesion during annealing wherein nickel is plated on a cold rolled steel plate in a thickness amount sufficient to prevent corrosion and then silicon hydrate is precipitated on the plated nickel by dipping or electrolysis treatment in a bath consisting essentially of sodium orthosilicate in a concentration sufficient to provide an anti-adherent coating, followed by heat treatment, to provide a surface layer sufficient to prevent adhesion to an adjacent sheet.

4. A manufacturing method of the nickel plated steel sheet as claimed in claim 3, wherein an anodic treatment and a cathodic treatment are alternatively carried out in a process of producing silicon hydrate layer on said plated nickel.

5. A method according to claim 3 wherein said nickel is plated on said cold rolled steel plate in a thickness of 0.5–10 μm, and said silicon hydrate is precipitated on said plated nickel by said dipping or said electrolysis treatment in said bath of sodium orthosilicate having a concentration of 1–7% of sodium orthosilicate so as to form 0.1–2.5 $mg/m^2$ of silicon oxide.

6. A manufacturing method of a nickel plated steel sheet treated for prevention of adhesion during annealing wherein nickel is plated on a cold rolled steel plate in a thickness amount sufficient to prevent corrosion and then silicon hydrate is precipitated on the plated nickel in a bath consisting essentially of sodium orthosilicate in a concentration sufficient to provide an anti-adherent coating at current density of 0.1–20 $A/dm^2$ and total quantity of electricity of 0.1–1000 $Coulomb/dm^2$, followed by heat treatment, to provide a surface layer sufficient to prevent adhesion to an adjacent sheet.

7. A manufacturing method of the nickel plated steel sheet as claimed in claim 6, wherein an anodic treatment and a cathodic treatment are alternatively carried out in a process of producing silicon hydrate layer on said plated nickel.

8. A method according to claim 6 wherein said nickel is plated on said cold rolled steel plate in a thickness of 0.5–10 μm, and said silicon hydrate is precipitated on said plated nickel in said bath of sodium orthosilicate at a sodium orthosilicate concentration of 1–7% so as to form 0.1–2.5 $mg/m^2$ of silicon oxide.

* * * * *